US008385769B2

(12) United States Patent
Yamaguchi et al.

(10) Patent No.: US 8,385,769 B2
(45) Date of Patent: Feb. 26, 2013

(54) IMAGE FORMING APPARATUS HAVING A PLURALITY OF CLEANING MEMBERS AND COMPUTER READABLE MEDIUM FOR THE SAME

(75) Inventors: Yoji Yamaguchi, Kanagawa (JP); Tomoya Ichikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 694 days.

(21) Appl. No.: 12/549,047

(22) Filed: Aug. 27, 2009

(65) Prior Publication Data

US 2010/0209134 A1 Aug. 19, 2010

(30) Foreign Application Priority Data

Feb. 17, 2009 (JP) ..... P2009-034175

(51) Int. Cl.
*G03G 15/02* (2006.01)

(52) U.S. Cl. ..... 399/100

(58) Field of Classification Search ..... 399/100, 399/170

See application file for complete search history.

(56) References Cited

U.S. PATENT DOCUMENTS

2006/0165430 A1* 7/2006 Gumbe ..... 399/100
2007/0014587 A1* 1/2007 Hasebe ..... 399/100

FOREIGN PATENT DOCUMENTS

JP 07-333950 12/1995
JP 09-034224 2/1997
JP 2001-194875 7/2001

* cited by examiner

*Primary Examiner* — Walter L Lindsay, Jr.
*Assistant Examiner* — Milton Gonzalez
(74) *Attorney, Agent, or Firm* — Morgan, Lewis & Bockius LLP

(57) ABSTRACT

An image forming apparatus, including: a plurality of charging members, each applying charging voltage between the charging member and corresponding charged body, a plurality of cleaning members, each removing adherent matters by reciprocating in a contact state with each of the charging members, each waiting in a waiting position in a non-cleaning time, a plurality of detection units, each detection unit detecting by availability of electric connection whether each of the cleaning members is located in the waiting position, and a series circuit that connects the plurality of detection units in series, wherein, when the plurality of cleaning members clean the plurality of charging members: an outward movement is started from a cleaning member on a side corresponding to one end of the series circuit, and a homeward movement is completed by the cleaning member on the side corresponding to the one end of the series circuit.

5 Claims, 10 Drawing Sheets

FIG. 10

(Example in case that time differences between image forming units in outward operation starting time are all the same)

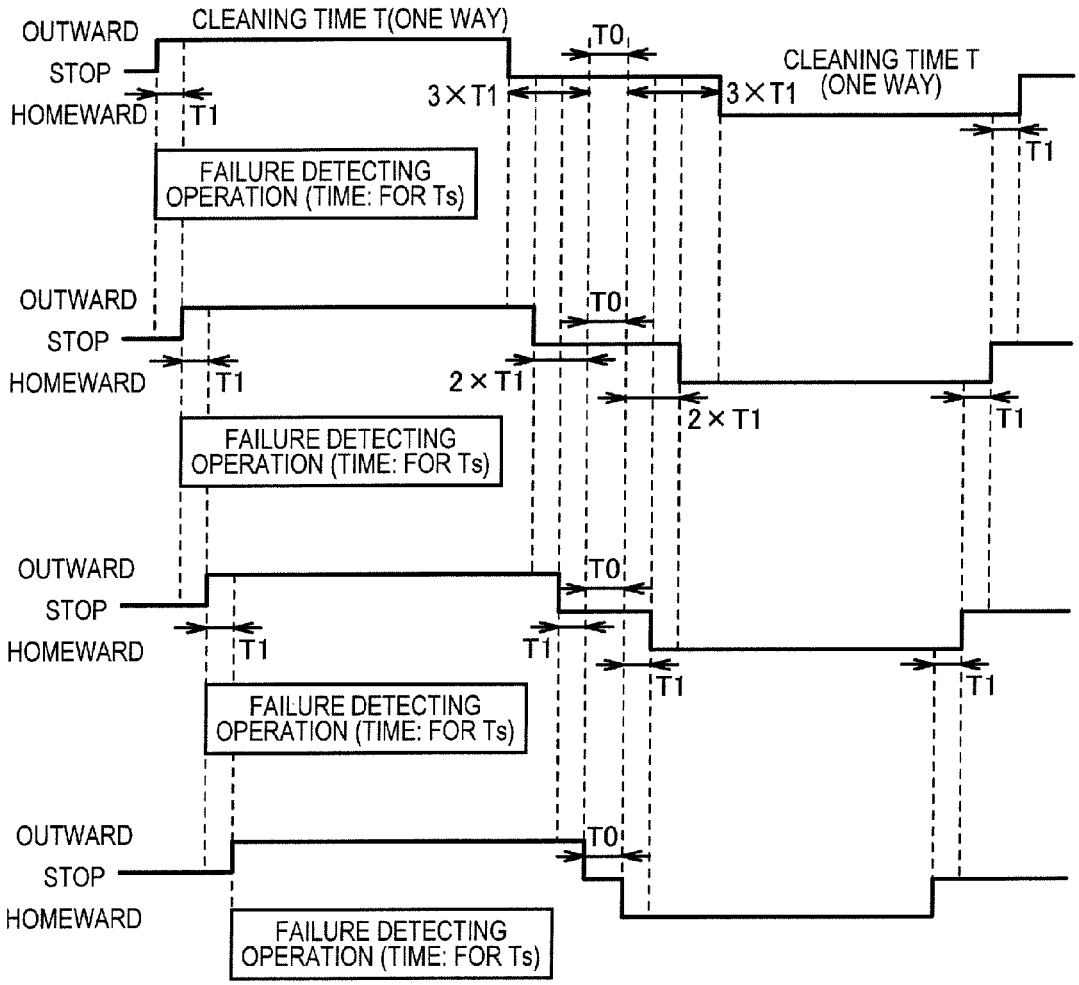

OUTWARD OPERATION

HOMEWARD OPERATION

By shifting the cleaning start timing by time T1, it can be decided that all engines have been appropriately separated from a home position (that cleaning has been started).

After each unit has started a cleaning operation, in case that an interlock circuit continues to detect the home position, a failure is produced.

After completion of an outward operation, cleaning members wait for the time T0 + T1×(X-A)×2, whereby timing of starting a homeward operation is reversed.
⇒ Since it can be decided that the cleaning members have reached the home position sequentially, the useless operation of a motor can be avoided.

After the cleaning member has started a homeward operation, in case that the interlock circuit does not detect the home position for the time T0+threshold, a failure is produced.

(Example in case that time differences between image forming units in outward operation starting time are different)

IMAGE FORMING APPARATUS HAVING A PLURALITY OF CLEANING MEMBERS AND COMPUTER READABLE MEDIUM FOR THE SAME

CROSS-REFERENCE TO RELATED APPLICATION

This application is based on and claims priority under 35 U.S.C. 119 from Japanese Patent Application No. 2009-034175 filed Feb. 17, 2009.

BACKGROUND

1. Technical Field

The present invention relates to an image forming apparatus and a computer readable medium.

2. Related Art

An image forming apparatus has been known, in which a surface of an image carrying body which may carry a toner development image on its surface is charged by a charging device to form an electrostatic latent image, and a development image obtained by developing the formed electrostatic latent image with toner is transferred and fixed onto a recording medium, thereby to form an image on the recording medium.

A charging device by corona charging is used in, for example, an electrophotographic image forming apparatus for the purpose of charging, at a predetermined potential, the image carrying body on which a latent image is to be formed by difference in electrostatic potential.

In the charging device used for such the purpose, a strong electric field is produced between a charging member such as a stretched wire and the image carrying body that is a charged body, and corona charging is generated. Therefore, particles having electric charges such as toner and paper powders can adhere to the charging member.

Further, corona products such as ozone and nitrogen oxide can also adhere to the charging member.

Since such the adherent matters may lower charging characteristic, it is necessary to remove the adherent matters from the charging member such the wire.

Therefore, a charging device having a cleaning member for cleaning a charging member and a drive unit for moving the cleaning member has been developed.

Further, various technologies regarding the charging device having such the cleaning member have also been proposed.

SUMMARY

According to an aspect of the present invention, there is provided an image forming apparatus including:

a plurality of charging members, each charging member applying charging voltage between the charging member and corresponding charged body;

a plurality of cleaning members, each cleaning member removing adherent matters by reciprocating in a contact state with each of the charging members and waiting in a waiting position in a non-cleaning time;

a plurality of detection units, each detection unit detecting by availability of electric connection whether each of the cleaning members is located in the waiting position; and a series circuit that connects the plurality of detection units in series, wherein, when the plurality of cleaning members clean the plurality of charging members: an outward movement is started from a cleaning member on a side corresponding to one end of the series circuit, and a homeward movement is completed by the cleaning member on the side corresponding to the one end of the series circuit.

BRIEF DESCRIPTION OF THE DRAWINGS

Exemplary embodiments of the invention will be described in detail based on the following figures, wherein:

FIG. 10 is a time chart showing an example in case that time differences between the image forming units in the outward operation starting time are all the same.

DETAILED DESCRIPTION

Figure 1:
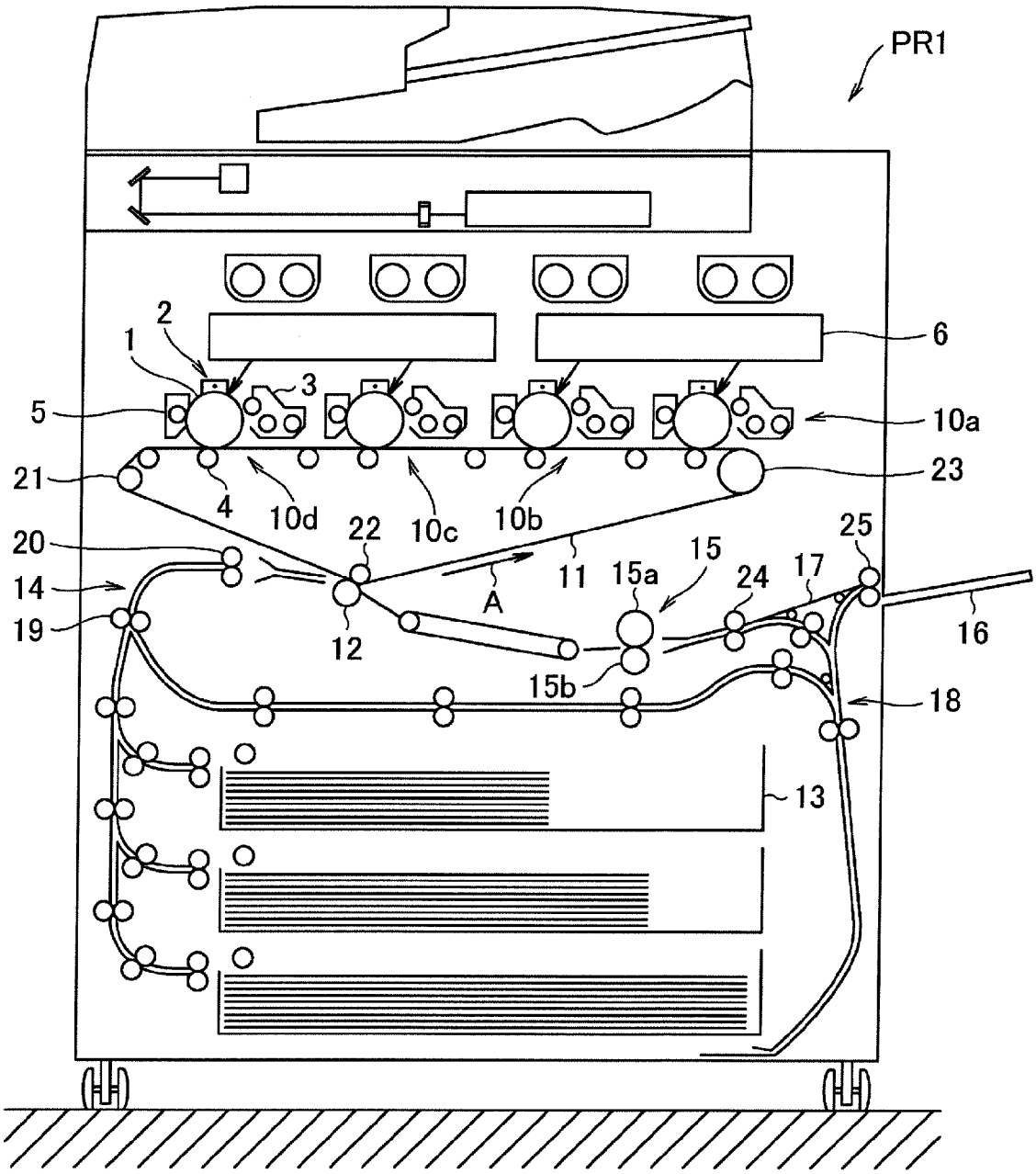
FIG. 1 is a schematic constitutional view showing the constitution of an image forming apparatus PR1 according to an exemplary embodiment.

One exemplary embodiment of the invention will be described below in detail with reference to drawings. Here, in the attached drawings, the same members are denoted by the same symbols, and the overlapped description is omitted. Since the following description is a best mode for carrying out the invention, the invention is not limited to this mode.

With reference to FIGS. 1 to 6, an image forming apparatus PR1 according to the embodiment of the invention will be described.

The image forming apparatus PR1 is a color printer, which includes a charging device according to one exemplary embodiment of the invention.

This image forming apparatus PR1 includes, as an example of an image forming unit, four image forming units 10*a*, 10*b*, 10*c*, and 10*d* which form toner images of yellow, magenta, cyan, and black. An endless belt-shaped intermediate transfer body 11 is supported so as to be opposed to these respective image forming units 10*a*, 10*b*, 10*c*, and 10*d*, and a circumferential surface of the endless belt-shaped intermediate transfer body 11 is circularly moved.

On the downstream side of the position where the image forming units are opposed to the intermediate transfer body 11 in the moving direction of this circumferential surface, a transfer roll 12 for performing secondary transfer is arranged so as to be opposed to the intermediate transfer body 11. Into this secondary transfer section, a recording medium (printing paper) is fed from a sheet tray 13 through a transport path 14.

On the downstream side of the secondary transfer section in the transport path of the recording medium, there is provided a fixing device 15 which heats and pressurizes the toner image to fix the toner image on the recording medium. On the more downstream side, there is provided a paper discharge tray 16 which accommodates therein the recording medium on which the toner image has been fixed.

Further, in the transport path from the fixing device 15 to the paper discharge tray 16, there is provided a gate 17 which is provided with a two-sided transport path 18 which reverses two sides of the recording medium and transports again the recording medium to the upstream side of the position where the transfer roll 12 is provided.

On the other hand, in the transport path 14 leading from the sheet tray 13 to the secondary transfer section, a transport roll 19 composed of two rolls opposed to each other is provided, which holds the recording paper between the two rolls, and is rotation-driven thereby to transport the recording medium. On the upstream side of the secondary transfer section, a registration roll 20 is provided, which adjusts timing at which the recording medium is fed to the secondary transfer section.

Figure 2:
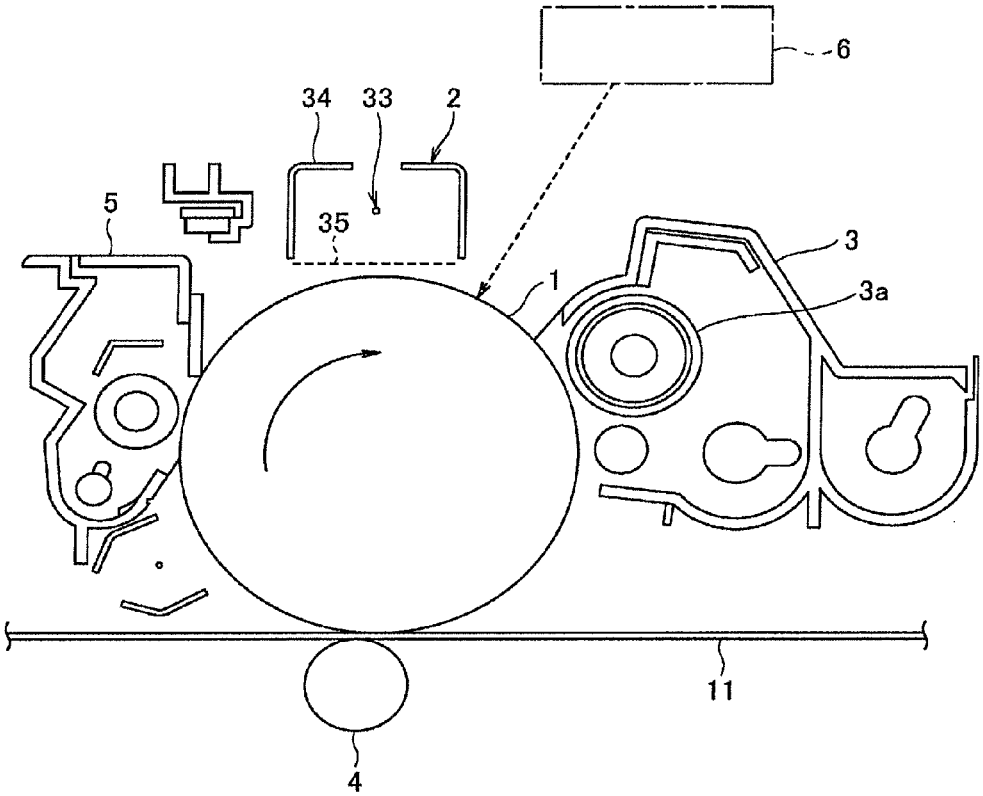
FIG. 2 is a schematic constitutional view showing a main part of the image forming apparatus PR1 according to the exemplary embodiment.
Figure 3:
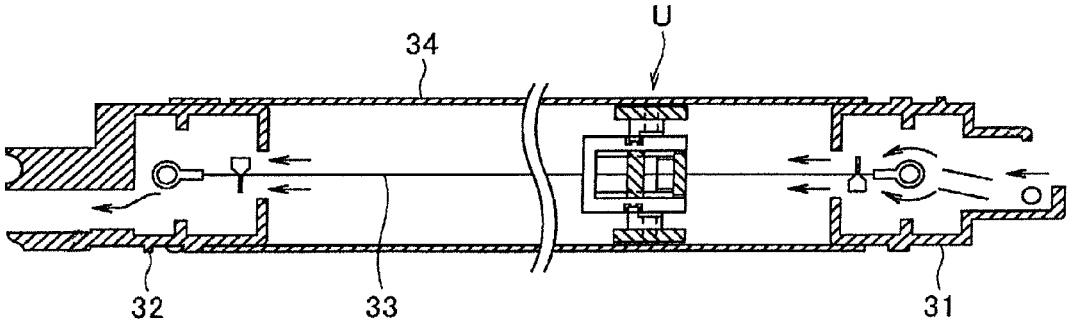
FIG. 3 is a constitutional view showing the constitution of a charging device.

Each of the image forming units 10*a*, 10*b*, 10*c* and 10*d*, as shown in FIG. 2, includes a photoconductor drum 1 as an example of a latent image bearing body, on which an electrostatic latent image is formed. Around each photoconductor drum 1, there are provided a scorotron charger 2 as an example of a charging device which charges the surface of the photoconductor drum in a substantially uniform way, a development device 3 which shifts selectively toner to the latent image formed on the photoconductor drum thereby to form a toner image, and a cleaning device 5 which collects the toner remaining on the photoconductor drum 1 after transfer.

Further, correspondingly to each photoconductor drum 1 charged uniformly, there are provided an image exposure unit 6 and a transfer device 4. The image exposure unit 6 irradiates the photoconductor drum 1 with image light based on an image signal thereby to write an electrostatic latent image on the photoconductor drum 1; and the transfer device 4 is provided for the intermediate transfer body 11 and primarily transfers the toner image on the photoconductor drum 1 onto an intermediate transfer body 11.

Further, the scorotron charger 2 and the image exposure unit 6 may be integrally formed to form an exposure unit, and this exposure unit may be attached to the apparatus and exchanged. Further, a system in which transfer is performed on the recording medium without using the intermediate transfer body 11 may be adopted.

The charging device, in the exemplary embodiment, is constituted as a scorotron charger, and includes an electrode wire 33 as an example of a charging member. The electrode wire 33 is stretched in a position where the circumferential surface of the photoconductor drum 1 which is a charged body can be charged. The charging device applies the voltage between this electrode wire 33 and the photoconductor drum 1 thereby to generate corona discharge, and charges the surface of the photoconductor drum 1.

The detailed constitution of this scorotron charger 2 will be described later.

The image exposure unit 6 generates laser beam which blinks on and off on the basis of image signals, and scans this laser beam on each photoconductor drum 1 in a main scanning direction. Hereby, an electrostatic latent image corresponding to the image of each color is formed on the surface of each photoconductor drum 1.

The development device 3 uses, as developer, two-component developer including toner and magnetic carrier. The developer is attracted by a development roll 3*a* opposed to the photoconductor drum 1 and conveyed.

The developer is made into a layer having the appropriate thickness on the development roll by a regulation blade, and supplied to the opposite position to the photoconductor drum 1. To the development roll 3*a*, a development bias voltage Vd of about −500V is applied in order to shift the toner to the electrostatic latent image on the photoconductor drum 1.

Inside the intermediate transfer body 11, a drive roll 21, an opposite roll 22, and a support roll 23 are arranged, and the intermediate transfer body 11 is stretched among these rolls and moves circularly in a direction of an arrow A in the figure.

The transfer roll 12 is provided in the opposite position to the above opposite roll 22, and pressed through the intermediate transfer body 11 against the opposite roll 22.

The fixing device 15 includes a heat roll 15*a* having a built-in heat source, and a pressure roll 15*b* which is brought into pressure contact with this heat roll 15*a*. These rolls are arranged in parallel to form a nip portion in which the recording medium is nipped.

The recording medium on which the toner image has been transferred is fed into the nip portion, and heated and pressed between the heat roll 15*a* and the pressure roll 15*b* which are rotation-driven; and the melted toner is fixed on the recording medium.

In the transport path on the downstream side of the fixing device 15, a transport roll 24 of the recording medium and a paper discharge roll 25 which feeds out the recording medium to the paper discharge tray 16 are provided; and between the transport roll 24 and the paper discharge roll 25, there is provided the gate 17 for switching the transport direction of the recording medium.

Next, with reference to FIGS. 3 to 6, the scorotron charger 2 will be described in detail.

The scorotron charger 2, as shown in FIGS. 3 to 6, includes a cleaning unit U for cleaning the electrode wire 33 and a grid 35.

This cleaning unit U includes a support body 36 as an example of a support member which moves along the axial direction of the electrode wire 33, a first pad 37 which is supported by this support body 36 and comes into contact with the electrode wire 33 from the opposite side to the photoconductor drum 1 side (from the back side), a second pad 38 which comes into contact with the electrode wire 33 from the photoconductor drum side, a brush 39 provided so as to come into contact with the grid 35, and a moving member 40 which is fitted into the support body 36 and moves the first pad 37 so that the first pad 37 comes into contact with or separates from the electrode wire 33.

The first pad 37 and the second pad 38 function as a cleaning member of the electrode wire 33, and the brush 39 is functions as a cleaning member of the grid 35.

Further, in order to move this cleaning unit U in the axial direction of the electrode wire 33, there is provided a screw member 41 which is rotation-driven around the axis in a state where both ends of the screw member 41 are supported respectively by an end member 31 on the front side and an end member 32 on the back side.

The screw member 41 is composed of a ball thread in which a spiral extrusion is provided on the circumferential surface of a metallic rod-shaped member, supported in parallel with the axis of the electrode wire 33, screwed to a screw hole provided for a drive transmission part 36*a* of the support body 36, and penetrates the drive transmission part 36*a*.

Accordingly, this screw member 41 is rotation-driven by an electric motor M (refer to FIG. 7: an example of drive unit) around the axis, whereby the screw member 41 may given the drive force in the axial direction to the support body 36.

The support body 36 includes a base part 36*b* which is arranged inside a shield case 34 and supports the pads 37, 38 and the brush 39, and the drive transmission part 36*a* which protrudes from this base part 36*b* through a slit provided in the shield case 34 outward.

The base part 36*b* is formed so as to surround the side and back side of the electrode wire 33 in relation to the circumferential surface of the photoconductor drum 1.

This support body 36 is supported by the screw member 41 that penetrates the drive transmission part 36*a*, and an edge part 34*a* of the slit provided in the shield case 34, and driven in the axial direction of the electrode wire 33 by the rotational drive of the screw member 41.

The first pad 37 is attached to a leading end of an arm 42 provided rotatably and movably for the support body 36, pressed against the electrode wire 33 from the back side by rotation of this arm 42 around a support shaft provided in an orthogonal direction to the electrode wire 33, and separated from the electrode wire 33 by the rotation in the opposite direction.

The second pad 38 is attached to a beam member 43 provided between the electrode wire 33 and the surface of the photoconductor drum 1, and the position of the second pad 38 is fixed in relation to the support body 36.

When the first pad 37 does not come into contact with the electrode wire 33, this second pad 38 is opposed to the electrode wire 33 from the photoconductor drum 1 side, and supported in a position slightly apart from the electrode wire 33.

On the other hand, when the first pad 37 is pressed against the electrode wire 33, the electrode wire 33 is displaced, and pressed against the second pad 38.

Figure 6:
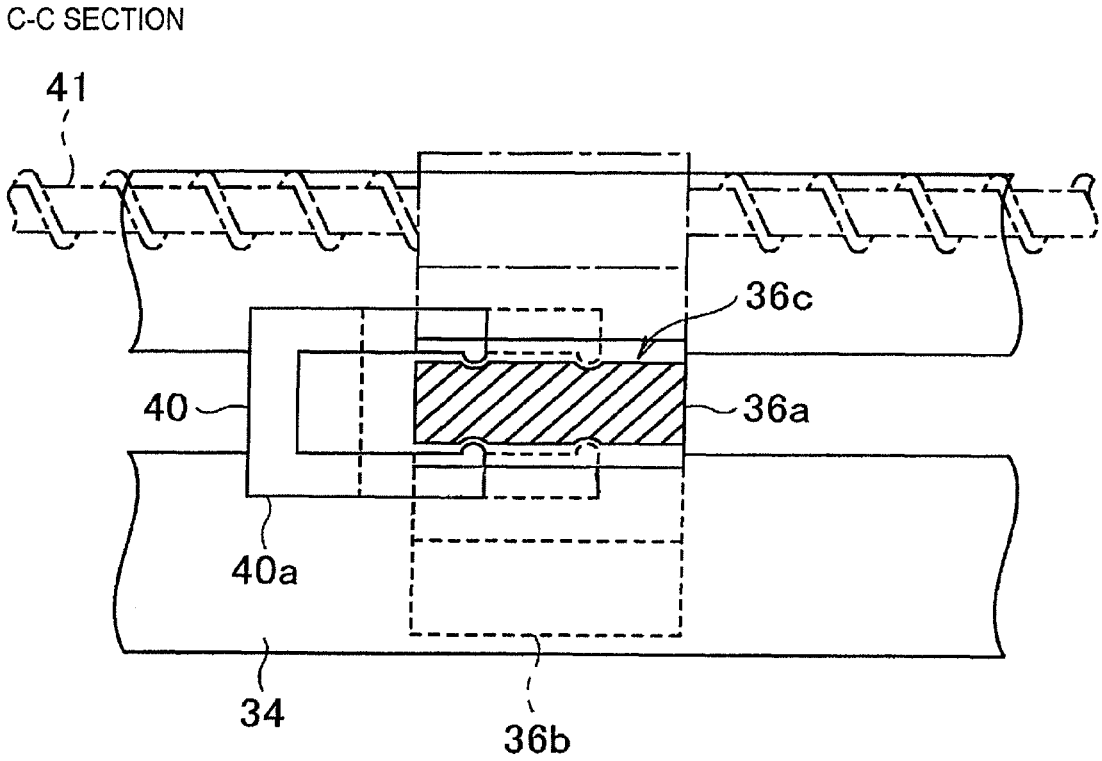
FIG. 6 is a sectional view showing the structure of the charging device and the structure of the cleaning unit provided for this charging device, which is a sectional view taken along a line C-C in FIG. 5.

The moving member 40 is fitted to the support body 36 from the back side of the image forming apparatus, a pair of protrusions 40*a* of the moving member 40 which protrude forward from the portion apart from the photoconductor drum 1 are fitted into grooves 36*c* provided for the drive transmission part 36*a* of the support body 36, and the moving member 40 is coupled to the support body 36 so as to sandwich this drive transmission part 36*a* between the protrusions 40*a* as shown in FIG. 6.

Further, an arm drive part 40*b* of the moving member 40 protrudes forward from the portion close to the photoconductor drum 1, and comes into contact with the photoconductor drum side of the arm 42 that supports the first pad 37.

Further, in a state where the moving member 40 is pulled out backward from the support body 36, the arm drive part 40 *b* retreats from the arm 42, and the first pad 37 is pressed against the electrode wire 33 by urging power of a spring 44 for the arm 42.

Accompanied with this press, the electrode wire 33 is displaced toward the circumferential surface side of the photoconductor drum 1, and pressed also against the second pad supported in the state where the position of the second pad is fixed in relation to the support body 36. Hereby, from both of the back side of the photoconductor drum 1 and the photoconductor drum side, the first pad 37 and the second pad 38 are pressed respectively against the electric wire 33

The relative movement of the moving member 40 in relation to the support body 36, and the contact and separation of the first pad 37 in relation to the electrode wire 33 accompanied with this relative movement are performed by the drive of the support body 36 in the axial direction of the electrode wire 33.

Figure 4:
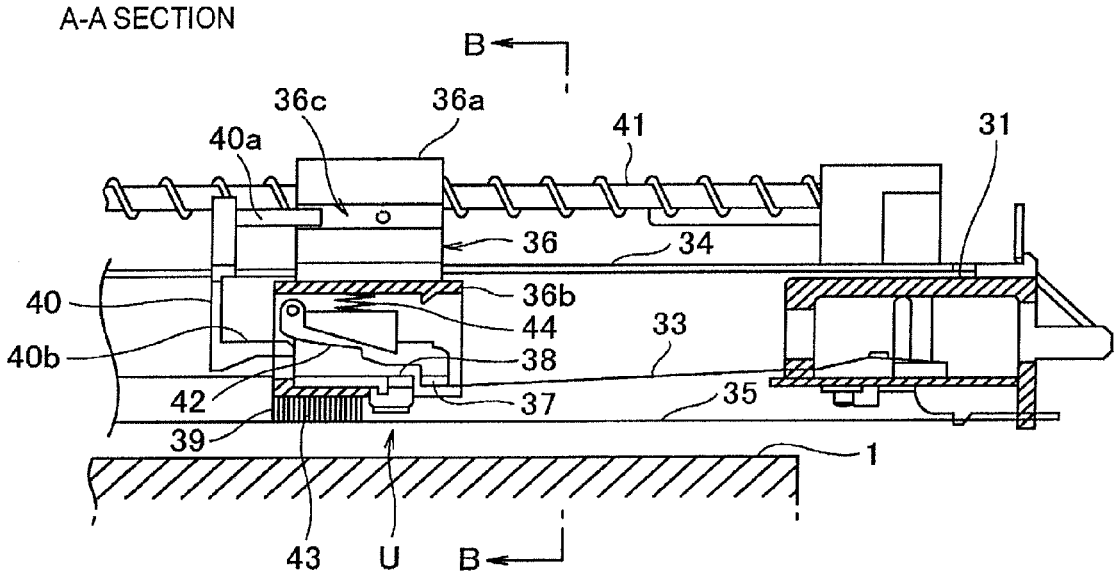
FIG. 4 is a sectional view showing the structure of the charging device and the structure of a cleaning unit provided for this charging device, which is a sectional view taken along a line A-A in FIG. 5.
Figure 5:
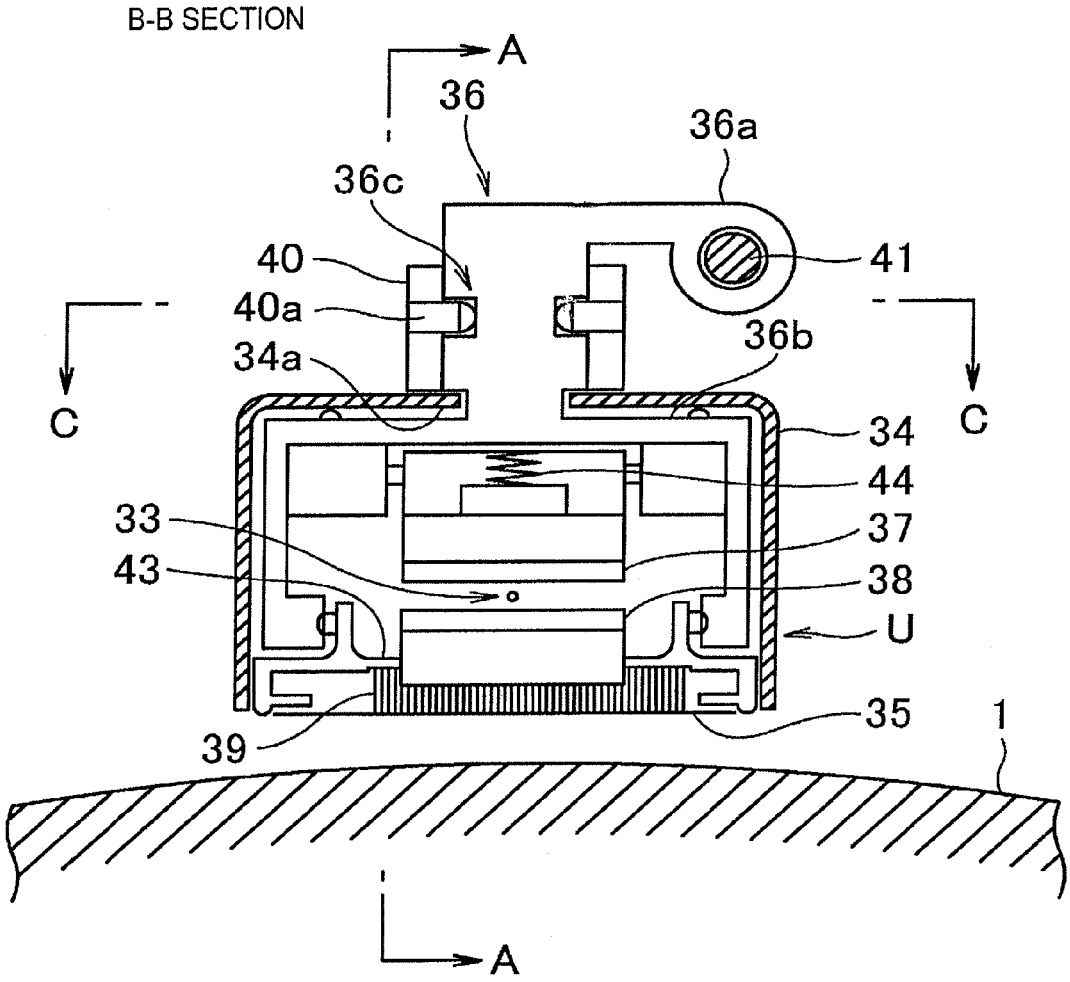
FIG. 5 is a sectional view showing the structure of the charging device and the structure of the cleaning unit provided for this charging device, which is a sectional view taken along a line B-B in FIG. 4.

When the support body 36 moves from the front side to the back side, as shown in FIG. 4, the moving member 40 moves in a state where it protrudes from the support body 36 to the backward side.

At this time, the first pad 37 and the second pad 38 come into contact with the electrode wire 33.

The support body 36 moves from the front side to the back side in a state where the first pad 37 and the second pad 38 are pressed against the electrode wire 33, whereby the electrode wire 33 is cleaned.

Further, when the support body 36 moves from the back side to the front side, the first pad 37 and the second pad 38 are separated from the electrode wire 33, and the support body 36 moves without cleaning the electrode wire 33.

Next, with reference to FIGS. 7 to 9, the configuration of a control system of the printer PR1 according to the exemplary embodiment will be described.

Figure 7:
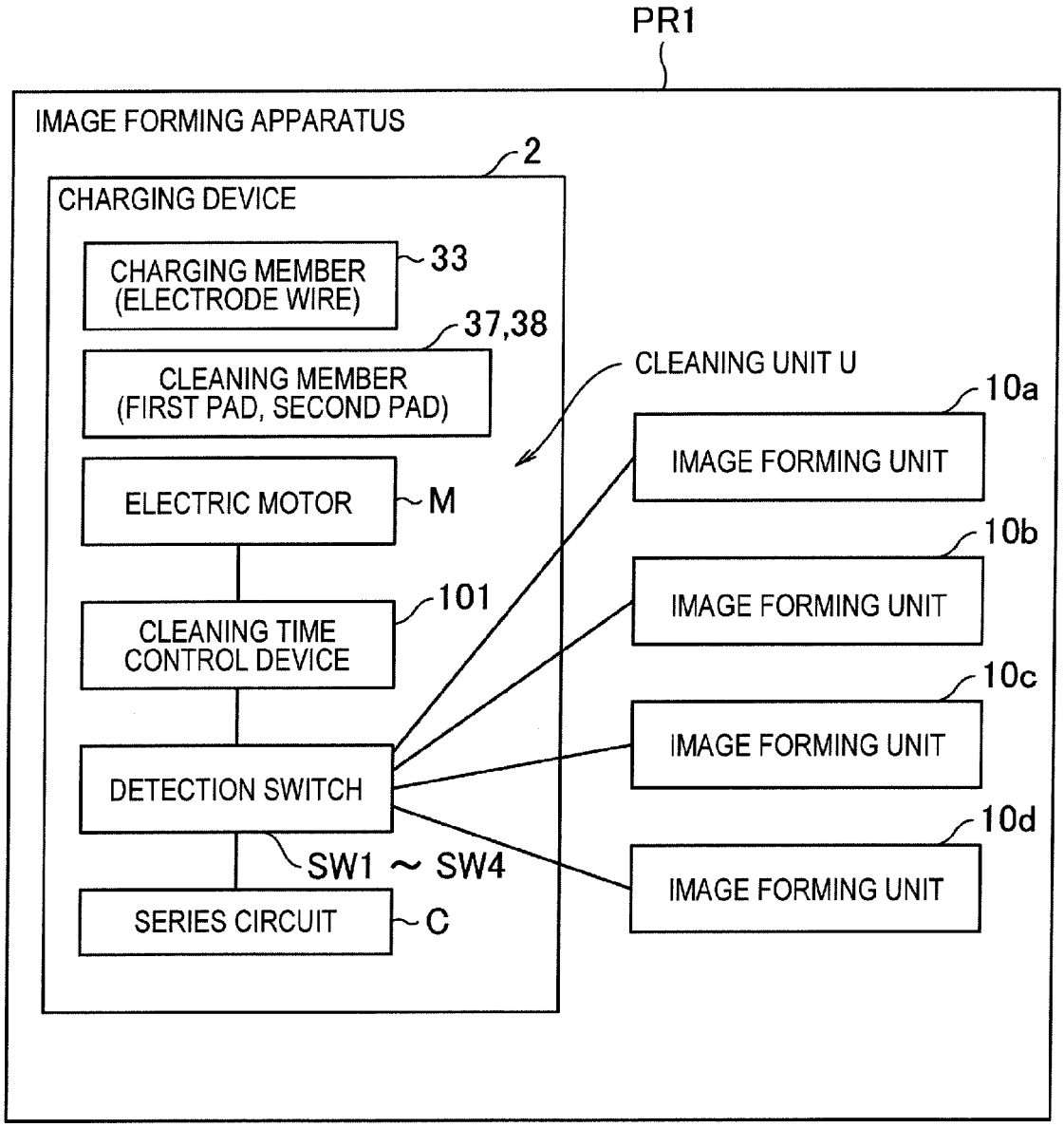
FIG. 7 is a functional block diagram showing the functional configuration of the image forming apparatus PR1 according to the exemplary embodiment.
Figure 8:
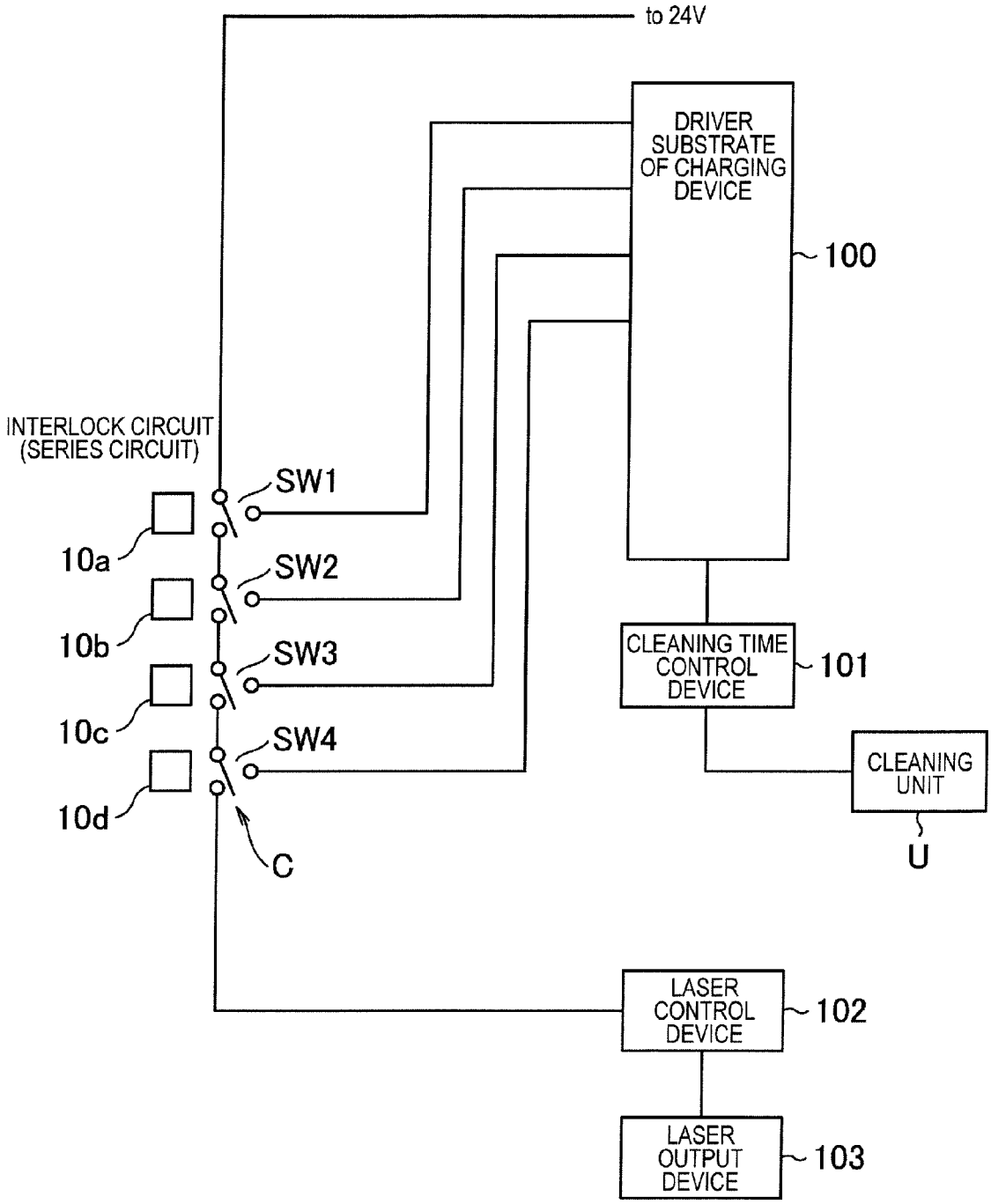
FIG. 8 is a circuit diagram showing a circuit configuration.
Figure 9:
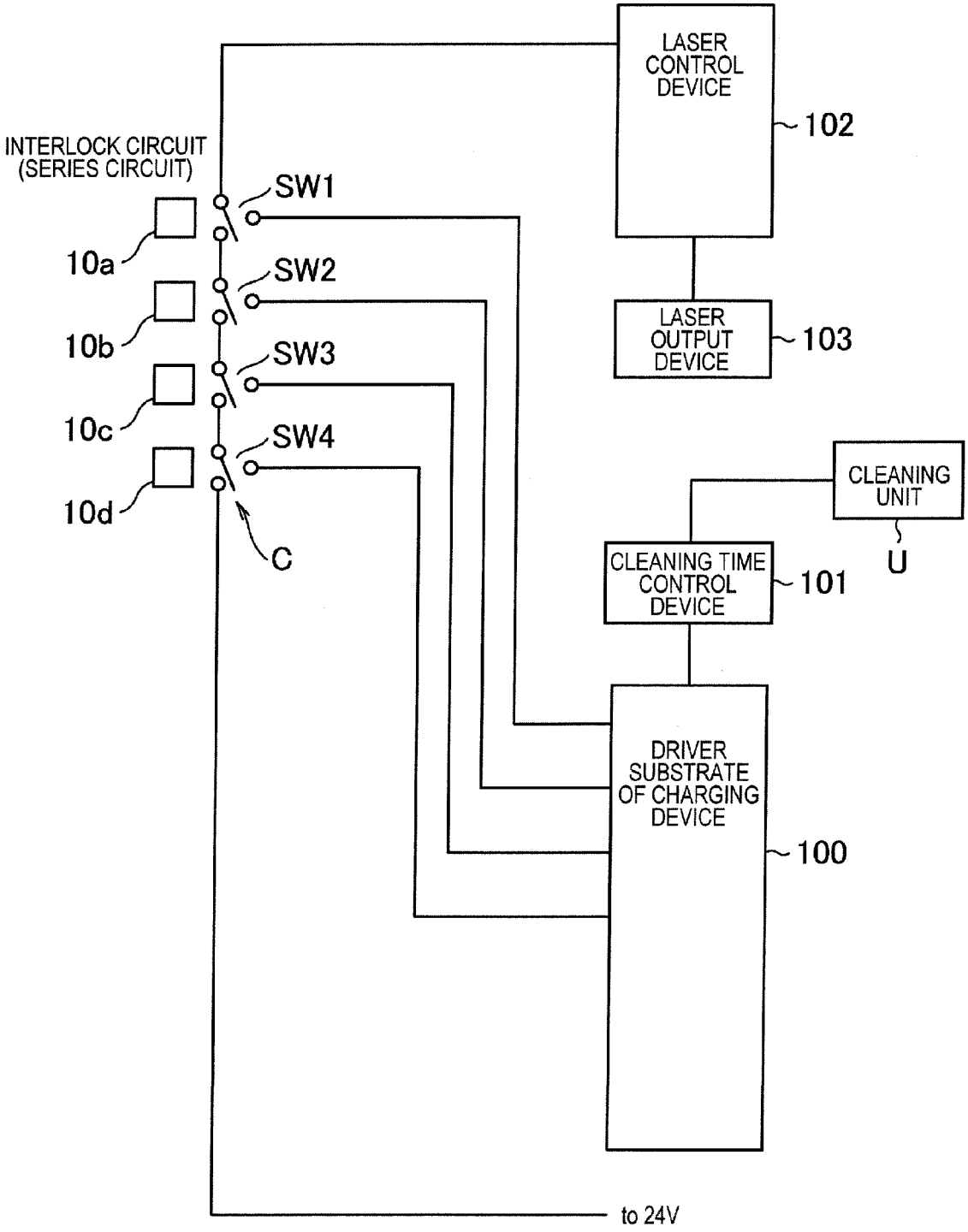
FIG. 9 is a circuit diagram showing another circuit configuration.

FIG. 7 is a functional block diagram showing the functional configuration of the printer PR1 according to the exemplary embodiment, and FIGS. 8 and 9 are circuit diagrams showing circuit configuration examples.

As shown in FIG. 8, the image forming units 10*a*, 10*b*, 10*c* and 10*d* are connected to one terminal of each of detection switches SW1 to SW4 which show an example of a detection unit. Using a series circuit in which the detection switches SW1 to SW4 are connected in series, an interlock circuit C for preventing a false operation of a laser control device 102 and a trouble due to the false operation is configured.

Each of the detection switches SW1 to SW4 is composed of a switch having two contacts so as to function as the interlock circuit C.

To the other terminal of each of the detection switches SW1 to SW4, a driver substrate 100 which drives the above-mentioned scorotron charger 2 is connected, and this driver substrate 100 is connected to a control device 101 (an example of a control unit) composed of a microcomputer.

Further, the control device 101 is connected to the above-mentioned cleaning unit U, and makes the electric motor M drive at the predetermined timing to reciprocate the cleaning member (first pad 37 and second pad 38) in the axial direction of the electrode wire 33, whereby the adherent matters are moved.

More specifically, the control device 101 controls the drive of the electric motor M such that the cleaning operation is started from the cleaning member (first pad 37 and second pad 38) on the one-end side of the series circuit C and completed by the cleaning member on the side corresponding to the one-end of the series circuit C.

Further, the control device 101 performs such control that time difference in cleaning start timing of each cleaning member (first pad 37 and second pad 38) of each image forming unit 10*a*, 10*b*, 10*c*, 10*d* becomes equal to or longer than time (T1) at which each detection switch SW1 to SW4 may detect that each cleaning member has separated from a waiting position where each cleaning member waits in the non-cleaning time.

Further, the control device 101 performs, after each cleaning member (first pad 37 and second pad 38) of each the image forming unit 10*a*, 10*b*, 10*c*, 10*d* has completed the outward operation, such control that: after each cleaning member has waited for a longer time than the below-indicated waiting time (T2), it starts the homeward operation.

$$\text{Waiting time } (T2)=T0+T1\times(X-A)\times 2$$

T0: common waiting time in shift from outward operation to homeward operation X: command number of cleaning operations A: starting order of cleaning-operation in command of cleaning operation Further, one end of the series circuit C is connected to a power source of 24V, and the other end thereof is connected to the laser control device 102 which controls the laser output device 103.

Further, in an image forming apparatus as a compared example, in order to reduce the cost, a unit for detecting the existence of the charging device and a unit for detecting whether the cleaning member is located in the home position are frequently constituted as a common device.

Therefore, when any cleaning member separates from the waiting position, break arises in a circuit which cuts off power for exposure.

Further, in case of the constitution in which a power circuit for exposure and a circuit for detecting a waiting position of the charging device are combined in order to simplify the circuit configuration, there is disadvantage that such troubles that the cleaning devices of all the charging devices move simultaneously from their waiting positions, and that any of the charging devices does not move from the waiting position cannot be decided.

In the printer PR1 according to the exemplary embodiment, the cleaning start timing and the cleaning completion timing of the cleaning member composed of the first pad 37 and the second pad 38 are made different among the image forming units 10*a*, 10*b*, 10*c* and 10*d*, whereby the start of cleaning is decided.

Further, by reversing the operation start timing in the homeward operation, the useless operation time of the electric motor M of the cleaning member (first pad 37 and second pad 38) is reduced.

Further, by adopting the configuration in which waiting is made before the homeward operation is started, it is not necessary to change the moving speed of the cleaning member according to each engine. Further, since the cleaning members in all the image forming units 10*a*, 10*b*, 10*c* and 10*d* move at the common moving speed, it is possible to prevent unevenness of cleaning performance caused by the different moving speed among the image forming units 10*a*, 10*b*, 10*c* and 10*d*.

Further, as a circuit example shown in FIG. 9, one end of the series circuit C may be connected to the laser control device 102 which controls the laser output device 103, and the other end thereof may be connected to the power source of 24V.

Figure 11:
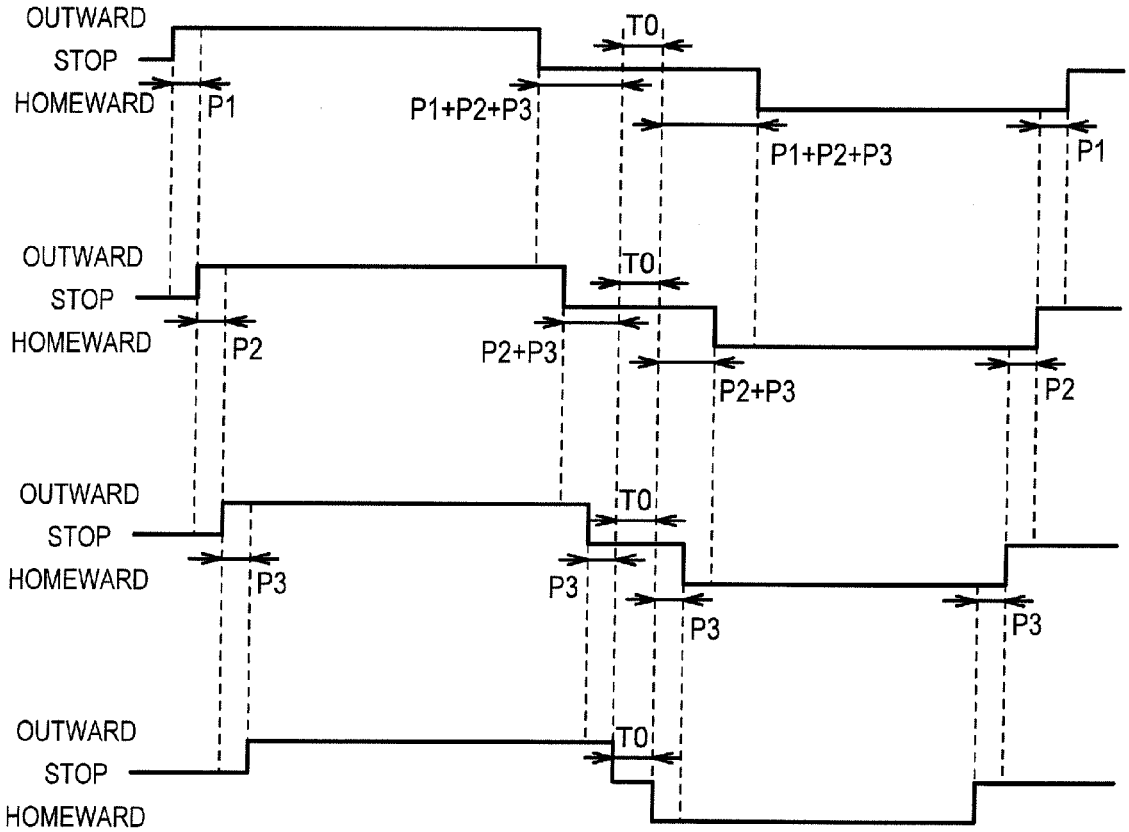
FIG. 11 is a time chart showing an example in case that time differences between the image forming units in the outward operation starting time are different.

Here, in time charts of FIGS. 10 and 11, examples of the cleaning operation are shown.

The time chart of FIG. 10 shows an example in case that time differences between the image forming units 10*a*, 10*b*, 10*c* and 10*d* in the outward operation starting time are all the same.

In this example, after an instruction on the outward operation start has been given to each cleaning member of the image forming units 10*a*, 10*b*, 10*c* and 10*d*, in case that it is kept detected that the cleaning member exists in the waiting position even if time Ts passes, failure is produced.

Further, after the cleaning member (first pad 37 and second pad 38) has started the homeward operation, in case that the interlock circuit C does not detect the home position for time T0+threshold, failure is produced, in which the T0 is the common waiting time in shift from the outward operation to the homeward operation, and the threshold is a value set to the time longer than the detection time necessary to decide whether cleaning is completed.

As shown in FIG. 10, by shifting the cleaning start timing by time T1, when the cleaning operation is started in the image forming units 10*a*, 10*b*, 10*c* and 10*d*, it is decided that the cleaning member has separated from the home position.

Further, after the completion of the outward operation, the cleaning member waits for the time T2=T0+T1×(X−A)×2, whereby the timing of starting the homeward operation is reversed.

T0: common waiting time in shift from outward operation to homeward operation, X: command number of cleaning operations, and A: starting order of cleaning-operation in command of cleaning operation Hereby, since it can be decided that the cleaning members have reached their home positions sequentially, it is possible to avoid the useless operation of the electric motor.

The time chart of FIG. 11 shows an example in case that time differences between the image forming units 10*a*, 10*b*, 10*c* and 10*d* in the outward operation starting time are different. As shown in FIG. 11, the cleaning start timing of each cleaning member shifts by P1, P2, and P3.

Hereby, the waiting time in cleaning is reduced, and the electric wire may be efficiently cleaned.

Although the invention made by the inventors has been described above in detail with reference to the exemplary embodiment, it is to be understood that the exemplary embodiment disclosed in this specification is illustrative in all points and not limited to the disclosed technology. Namely, the technical scope of the invention is not interpreted restrictively on the basis of the description in the exemplary embodiment, but is to be interpreted in accordance with the description, and equivalence of the technology are embraced.

Further, in case that a program is used, it may be provided through a network, or provided in a stored state in a recording medium such as a CD-ROM or the like.

Namely, provision of a predetermined program including an image processing program is not limited to a case where the predetermined program is stored in a storage device such as a hard disc as a recording medium, but may be also performed as follows.

For example, a predetermined program is previously saved in a ROM, and a CPU loads this predetermined program into a main storage device from this ROM, whereby the program may be executed.

Further, the above predetermined program may be stored in a computer readable recording medium such as a DVD-ROM, a CD-ROM, an MO (magneto-optical disc), or a flexible disc to be distributed.

Furthermore, an image processing device is connected through a communication line (for example, Internet) to a server device or a host computer; and after the above predetermined program has been downloaded from the server device or the host computer, this predetermined program may be executed. In this case, as download destination of this predetermined program, there is a memory such as a RAM or a storage device (recording medium) such as a hard disc.

The image forming apparatus and the control program according to the invention may be applied to a copying machine, a laser printer, a full-color printer, a multifunctional machine, a facsimile device, or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An image forming apparatus, comprising:

a plurality of charging members, each charging member applying charging voltage between the charging member and corresponding charged body;

a plurality of cleaning members, each cleaning member removing adherent matters by reciprocating in a contact state with each of the charging members, each of the cleaning members waiting in a waiting position in a non-cleaning time;

a plurality of detection units, each detection unit detecting by availability of electric connection whether each of the cleaning members is located in the waiting position; and a series circuit that connects the plurality of detection units in series, wherein, when the plurality of cleaning members clean the plurality of charging members:

an outward movement is started from a cleaning member on a side corresponding to one end of the series circuit, and a homeward movement is completed by the cleaning member on the side corresponding to the one end of the series circuit.

2. The image forming apparatus according to claim 1, wherein:

a time difference at a cleaning start time of each of the cleaning members is equal to or longer than time (T1); and the time (T1) represents time at which the detection unit may detect that each of the cleaning members has separated from an initial position.

3. The image forming apparatus according to claim 2, wherein:

after each of the cleaning members has completed the outward operation, the plurality of cleaning members wait for waiting time (T2), and thereafter start the homeward operation; and the waiting time (T2) satisfies following equation:

$$T2=T0+T1\times(X-A)\times 2$$

where:

T0 represents common waiting time in shift from outward operation to homeward operation, X represents command number of cleaning operations, and A represents starting order of cleaning-operation in command of cleaning operation.

4. A non-transitory computer readable medium storing a program causing a computer to execute a process for controlling, the process comprising:

starting an outward movement in an order of a first cleaning member and then a second cleaning member, the first cleaning member removing adherent matters by reciprocating in a contact state with a first charging member and waiting in a waiting position in a non-cleaning time, the second cleaning member removing adherent matters by reciprocating in a contact state with a second charging member and waiting in a waiting position in a non-cleaning time; and completing a homeward movement in an order of the second cleaning member and then the first cleaning member.

5. An image forming apparatus, comprising:

a plurality of charging members, each charging member applying charging voltage between the charging member and corresponding charged body;

a plurality of cleaning members, each cleaning member removing adherent matters by reciprocating in a contact state with each of the charging members, each of the cleaning members waiting in a waiting position in a non-cleaning time;

a plurality of detection units, each detection unit detecting by availability of electric connection whether each of the cleaning members is located in the waiting position; and a series circuit that connects the plurality of detection units in series, wherein, when the plurality of cleaning members clean the plurality of charging members:

an outward movement is started from a cleaning member on a side corresponding to one end of the series circuit, and a homeward movement is started from a cleaning member on a side corresponding to the other end of the series circuit.

* * * * *